United States Patent [19]

Lucke

[11] 4,183,194

[45] Jan. 15, 1980

[54] APPARATUS FOR PRODUCING A WRAPPER CLOSED BY A WELD SEAM FOR BALLS OF YARN

[75] Inventor: Florian Lucke, Mengen, Fed. Rep. of Germany

[73] Assignee: Lucke Apparate-Bau Gesellschaft Mit Beschrankter Haftung, Fed. Rep. of Germany

[21] Appl. No.: 937,689

[22] Filed: Aug. 28, 1978

[30] Foreign Application Priority Data

Sep. 1, 1977 [DE] Fed. Rep. of Germany ..... 2739329

[51] Int. Cl.[2] ..... B65B 43/36

[52] U.S. Cl. ..... 53/571; 53/373; 53/385

[58] Field of Search ..... 53/571, 572, 373, 385

[56] References Cited

U.S. PATENT DOCUMENTS 4,018,031 4/1977 Smaw ..... 53/572 X

FOREIGN PATENT DOCUMENTS 2512004 9/1976 Fed. Rep. of Germany .

2643785 . 4/1978 Fed. Rep. of Germany .

*Primary Examiner*—Travis S. McGehee

*Attorney, Agent, or Firm*—Leydig, Voit, Osann, Mayer & Holt, Ltd.

[57] ABSTRACT

Apparatus for producing a wrapper closed by a weld seam from a plastics bag open at one side, for balls of yarn or the like, wherein the balls are insertable from a collecting duct into the uppermost bag of a stack of bags arranged in a magazine and the bag opening is closable by means of a welding device after the formation of lateral folds by means of two folder members, wherein the collecting duct is movable at least partly into the stationarily held bag and the welding device is reciprocable between an operative position and an inoperative position, and wherein the magazine which is located in the displacement path of the welding device together with the remainder of the stack located thereon may be tilted out of this path in the operative position of the welding device.

15 Claims, 24 Drawing Figures

51
49
54
D
B
52
E
14
46
47
21
22
34
32
16
22
23
28
44
42
43
1
2
17
18
24
25
5
13
19
53
4
C
55
48

49
51
54
22
14
52
16
21
23
28
32
25
47
46
53
34
2
24
42
13
44
55
19
5
1
4

51
49
14
22
52
54
34
28
32
16
21
23
47
46
8
42
53
55
2
17
18
24
25
13
44
19
5
1
4

14
22
x
y
z

APPARATUS FOR PRODUCING A WRAPPER CLOSED BY A WELD SEAM FOR BALLS OF YARN

This invention relates to apparatus for producing a wrapper closed by a weld seam from a plastics bag open at one side, for balls of yarn or the like, wherein the balls are insertable from a collecting duct into the uppermost bag of a stack of bags arranged in a magazine and the bag opening is closable by means of a welding device after the formation of lateral folds by means of two folder members.

It is known (from Federal Republic of Germany Offenlegungsschrift No. 2512004) to push empty plastics bags removed from a bag magazine singly by hand onto a stationary collecting duct, to push the balls of yarn into the bag, and to pull the filled bag of the collecting bag again and to displace it onto a packing table where the bag is welded by a stationary device, without the formation of a fold, to complete the wrapper. Furthermore, it has already been proposed (in Offenlegungsschrift No. 2643785) to pull empty plastics bags coming from a magazine automatically upon a stationary collecting duct, to fill them with balls of yarn, to pull them off the collecting duct again and thereafter to feed the filled bags to a separately disposed station at which a fold is folded in the folder members and the bag is welded closed. In both cases the still unclosed bag filled with balls of yarn must be displaced and fed to the welding device, which may be disadvantageous because the balls of yarn can change their position in the bag during the movement of the still open bag.

It is an object of the present invention to provide apparatus for producing a wrapper closed by a weld seam, for balls of yarn or the like, wherein the respective uppermost bag of a stack of bags arranged in a magazine is filled at the location of the stack and the bag opening is welded without change of position of the bag and with the formation of two folds, so that the packaging charge contained in the bag cannot change its position between filling and welding.

The present invention provides apparatus for producing a wrapper closed by a weld seam from a plastics bag open at one side, for balls of yarn, comprising a collecting duct for holding balls of yarn, means for inserting the balls from the collecting duct into the uppermost bag of a stack of bags arranged in a magazine, two folder members for forming lateral folds in the bag, a welding device for closing the bag opening after the formation of the lateral folds by means of the two folder members, means for moving the collecting duct at least partly into the stationarily held bag, means for reciprocatingly moving the welding device between an operative position and an inoperative position, and means for tilting the magazine which is located in the displacement path of the welding device together with the remainder of the stack located thereon out of the said path in the operative position of the welding device.

The invention will be further described, by way of example only, with reference to the accompanying drawings, in which:

FIG. 1 is a side view of apparatus according to the invention for producing a wrapper for balls of yarn or other goods to be wrapped which is closed by a weld seam;

FIG. 1*a* is a partial view from above in the direction of the arrow B in FIG. 1;

Figure 11:
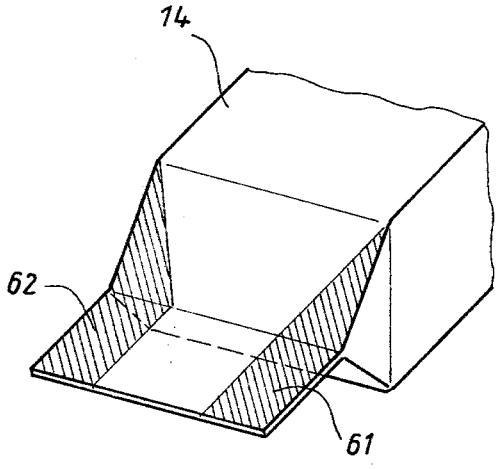
Figure 8A:
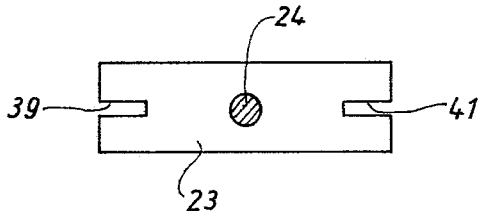
FIGS. 8, 9 and 10 are views from above of the collecting bag during filling of the plastics bag.
Figure 12:
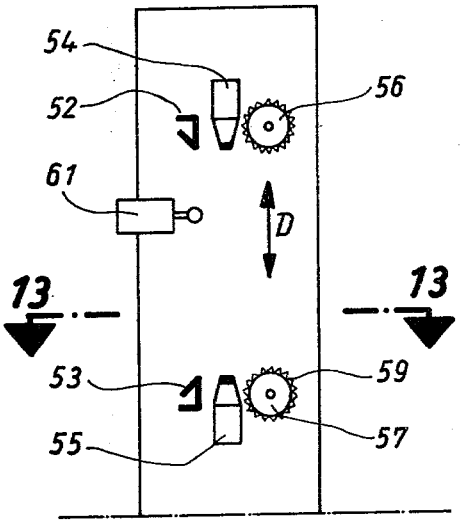
Figure 13:
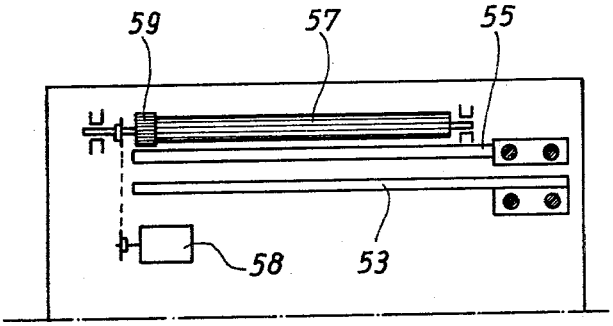

FIG. 8*a* is a rear view of a plunger;

FIG. 11 is a perspective view showing the finished fold produced at the opening of the plastics bag;

FIG. 12 is a diagrammatic side view of a welding device;

FIG. 13 is a diagrammatic sectional view of the welding device shown in FIG. 12; and FIGS. 14 to 22 show various possible arrangements for wrapping balls of yarn.

Figure 1:
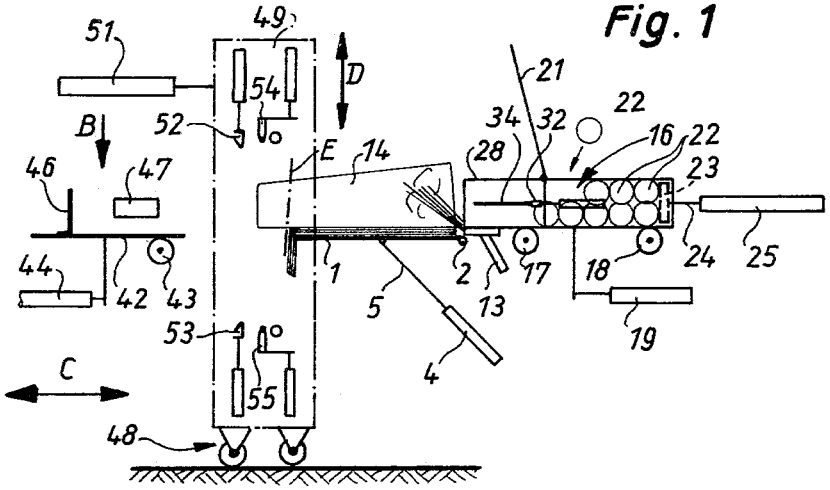
Figure 2:
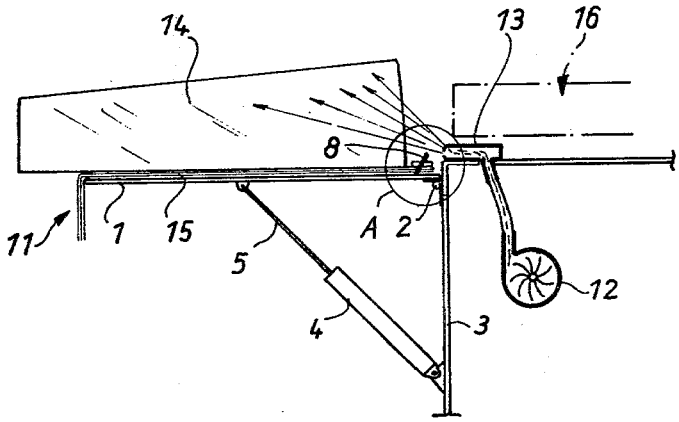
FIG. 2 is a side view, enlarged in relation to FIG. 1, pf a bag magazine.
Figure 3:
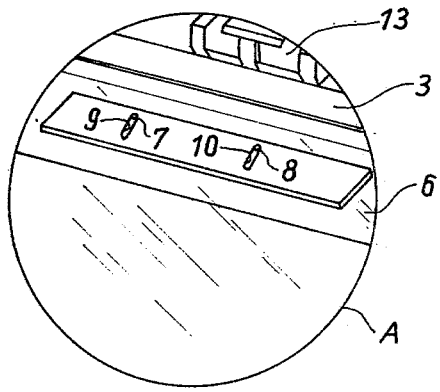
FIG. 3 is an enlarged view of the region indicated by the circle A in FIG. 2.

The drawings show a folding table 1 serving as bag magazine which is pivotally mounted by means of a hinge 2 on a frame 3 (FIG. 2). By means of a pressure cylinder 4 which is pivotally mounted on the frame 3 and the piston rod 5 of which is pivotally connected to the table 1, the latter can be swung from the position illustrated at FIG. 1 to the position shown in FIG. 5. A stack of plastics bags lies on the table 1. The bags comprise at their openings a projecting lug 6 provided at the lower bag wall (FIG. 3) at which they are pushed onto two, preferably pointed, pins 7, 8 which project upwardly from the table. Thereafter a relatively heavy metal plate provided with elongate holes 9, 10 is placed over the pins and thereby upon the lugs 6, whereby the plastics bags are securely retained on the table. In relation to the plastics bags the table 1 has a length such that the ends 11 thereof (FIG. 2) hang down over the rear edge of the table; in other words the plastics bags are slightly longer than the table 1.

Figure 4:
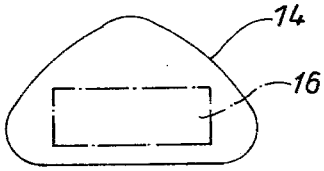
FIG. 4 is a front view of the bag opening after inflating the bag.

As may be seen in particular from FIG. 2, an air nozzle 13 fed by a blower 12 is arranged at the end of the frame 3 which is adjacent the frame 1, and its blow opening is so constructed and directed that it blows compressed air into the respective uppermost bag 14. The bag is thus opened, and its rear end is expanded under the effect of the air blown in and is lifted off the remainder of the stack 15 located on the table 1. FIG. 4 illustrates the opening of the plastics bag 14 after inflating the bag. In order to facilitate the placing of the lugs 6 over the pins 7, 8 the lugs may be provided with two corresponding holes.

Figure 7:
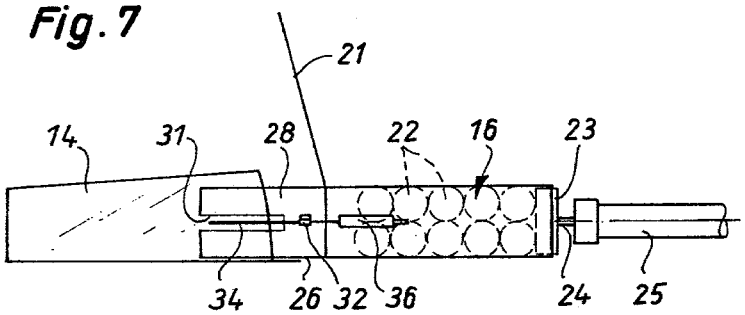
FIG. 7 is an enlarged side view of the collecting duct during filling of the plastics bag.
Figure 8:
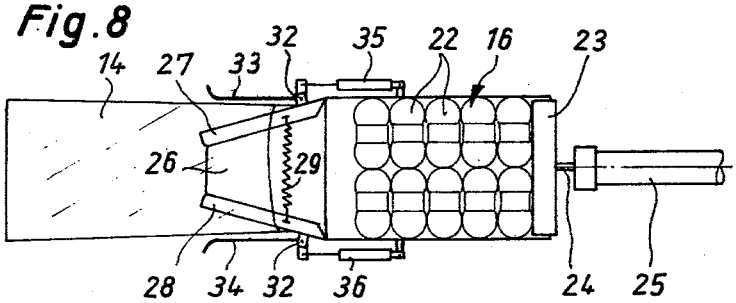

In the vicinity of the bag opening and aligned therewith, in front of the magazine, is disposed a collecting duct 16 which is reciprocable by means of cylinders 19 actuated by a pressure medium on a horizontal guide which is indicated diagrammatically by two rollers 17, 18 in FIG. 1. After opening a lid 21 the collecting duct 16 can be filled with balls of yarn 22 in one or more layers. The collecting duct 16 is of box-like construction and is closed at its forward end (i.e. the end nearest the table 1) by a plate-shaped plunger 23 which is reciprocable in the duct 16 by the piston rod 24 of a pressure cylinder 25. The plunger 23, the configuration of which is illustrated in FIG. 8*a*, fills substantially the entire internal cross-sectional area of the collecting duct 16, so that the entire wrapping charge located in the collecting duct 16 is displaced. As is clear from FIGS. 7 to 10, the bottom of the collecting duct 16 is extended by a tongue 26 having the configuration as shown. Respective flaps 27 and 28 are pivotally mounted on the side walls of the duct 16 and in the rest state they are held in abutment with the sides of the tongue 26 by a spring 29 (FIG. 8). When the plunger 23 has been fully inserted into the collecting duct 16 (FIG. 9), it presses the flaps 27, 28 apart against the action of the spring 29. After return of the plunger 23 to the starting position thereof, the flaps 27, 28 again assume the position illustrated in FIG. 8. (FIG. 10), under the action of the spring 29. In the region of their free ends, the two flaps 27, 28 which continue the side walls of the collecting duct 16 have horizontally extending slots 31 (FIG. 7).

In the forward region of the flaps 27, 28 a respective folder member 33 or 34 is pivotally mounted in bearings 32, and each folder member is pivotally displaceable by an associated pressure cylinder 35 or 36, respectively, which is pivotally attached to a side wall of the collecting duct 16. The folder members 33, 34 are thereby swung from the position illustrated in FIG. 1 into the position shown in FIG. 10, the folder members penetrating through the respective slots 31 provided in the flaps 27, 28. As illustrated in FIG. 8*a* the plunger 23 may also have lateral slots 39, 41 which likewise may serve for the entry of the folder members. When these slots 39, 41 are not provided, the free ends of the folder members 33, 34 lie against the side faces of the plunger 23 (FIG. 9) until the plunger 23 has been withdrawn again (FIG. 10).

Figure 1A:
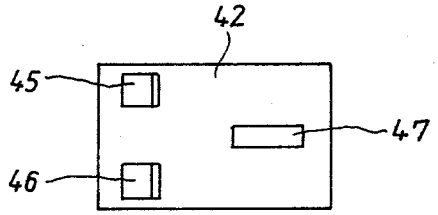

As may be seen in particular from FIG. 1. a support plate 42 which is horizontally displaceable in the direction of the arrow C is provided in front of the folding table 1 and the stack of bags disposed thereon. The plate 42 is in turn supported by a horizontal guide which is indicated diagrammatically by a roller 43 in FIG. 1. A pressure cylinder 44 the piston rod of which is rigidly connected to the support plate 42 ensures the advance and return stroke of the plate. Two upwardly projecting abutments 45, 46 (FIG. 1*a*) are rigidly arranged on the upper surface of the support plate 42. An ejector 47 lies above the support plate 42 at the level of the bag 14 and is rigidly connected to a stationary machine frame (not illustrated) in such a manner that the abutments 45, 46 may travel past unimpeded during the advance and return stroke of the support plate 42.

A welding device 49 is reciprocably displaceable likewise in the direction of the arrow C by means of a pressure cylinder 51, on a roller guide 48 which is indicated in a merely diagrammatic manner in FIG. 1. The welding device 49 is of a known construction and, as indicated diagrammatically in FIGS. 12 and 13, comprises holding-down members 52, 53, welding jaws 54, 55 and draft rollers 56, 57 which are vertically displaceable in the direction of the double-arrow D and are always provided in pairs. The draft roller 57 is driven by a motor 58 (FIG. 13) and supports on its one side a gear wheel 59 which comes into meshing engagement with a corresponding gear wheel at the draft roller 56 when the two rollers move towards one another and which in this way drives the draft roller 56. An end switch 61 actuated by the mutually approaching parts of the welding device serves in a known manner for activating (heating) the welding jaws 54, 55.

Figure 5:
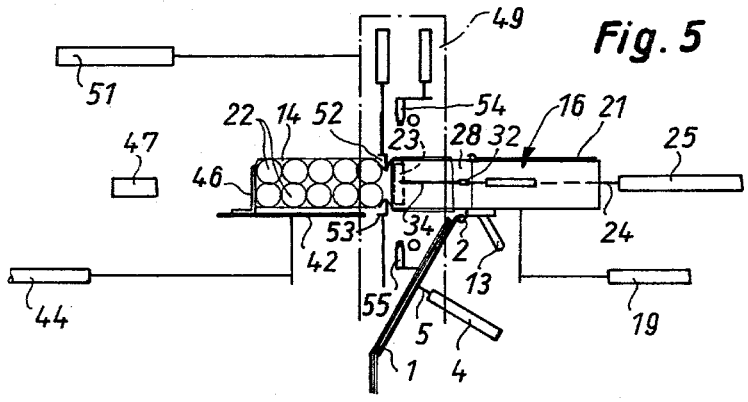
FIG. 5 is a view similar to FIG. 1 in another operational phase of the apparatus.

The apparatus described above operates in the following manner. After a stack of bags has been fixed on the folding table 1, the bag 14 lying uppermost is inflated by means of the air nozzle 13, whereby its end is lifted off the remainder of the stack and is horizontally straightened out. With the lid 21 open the collecting duct is filled with balls 22 or another wrapping charge. Thereupon the filled collecting duct is displaced towards the stack of bags by the pressure cylinder 25, whereby the flaps which serve as guide jaws and the edges of which may be flanged over at the bottom and/or at the top penetrate into the bag (see FIGS. 5 and 7 to 10) through the bag opening blown open into the bag 14. Initially the support plate 42 with the abutments 45, 46 advances to the position which is indicated by the broken line E in FIG. 1 and in which the leading end of the plate 42 supports the end of the inflated bag 14 which is lifted off the remainder of the stack. Thereupon the folding table 1 together with the remainder of the stack located thereon is swung downwardly by actuation of the cylinder 4, so that the inflated bag 14 is held still merely at its ends and the way is free for the advance of the welding device 49 to the operative position thereof (FIG. 5). By actuation of the associated cylinders 51 and 44 respectively, the welding device 49 and the support plate 42 then travel to their operative position, the support plate 42 substantially completely supporting from below the bag 14 to be filled (see FIG. 5) and the abutments 45, 46 resting against the rear side of the bag.

Figure 9:
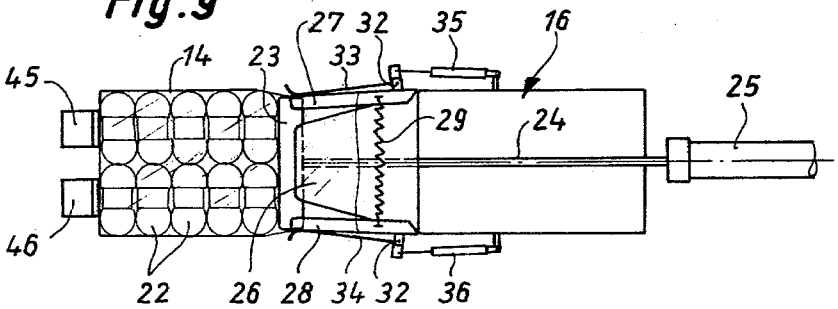
Figure 10:
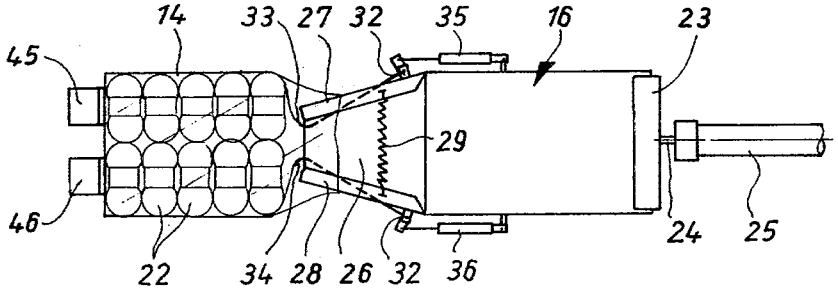

By actuation of the cylinder 25, the plunger 23 then pushes the balls 22 out of the collecting duct 16 into the plastics bag 14 (FIGS. 5 and 9). The holding-down members 52, 53 are pushed together by pressure cylinders connected to them (FIG. 5), whereby the balls 22 in the bag 14 are pressed together slightly owing to the inclinded edge faces formed on the holding down members. Furthermore, owing to the tension occurring thereby in the foil forming the bag, the lug 6 by means of which the back is fixed on the pins 8, 9 is torn off the remaining bag. By actuating the cylinder 35, 36 the folder members 23, 24 are then moved together and penetrate through the slots 31 and 39, 41 at the flaps 27, 28 and the plunger 23, respectively, and begin to form a respective lateral fold in the portion of the bag foil adjacent the bag opening which is not filled with balls. After the return movement of the plunger 23 (FIG. 10) the folder members 33, 34 move finally together and press the fold in the plastics bag to its final form. It has been found that the parts of the apparatus which remain partly still in the plastics bag at the beginning of the fold formation and which are provided with the slots 31 and 39, 41 respectively considerably favour the formation of the fold, in comparison with fold forming devices known heretofore.

Figure 6:
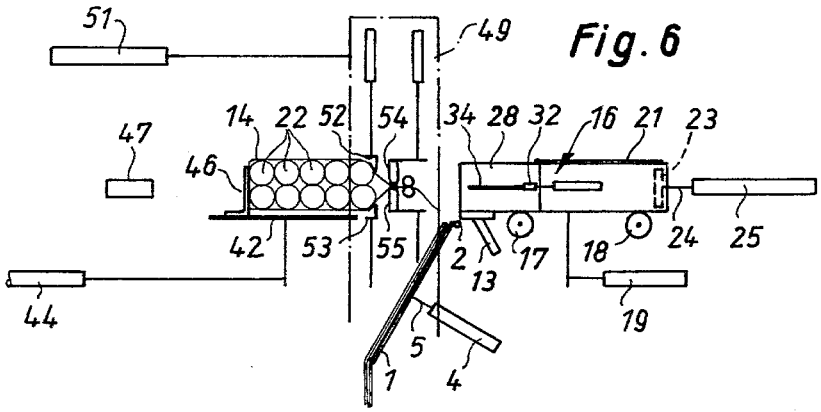
FIG. 6 is a side view of the apparatus of FIGS. 1 and 5 in yet another operational phase.

After the collecting duct 16 has travelled back again by actuation of the cylinder 19 (FIG. 6) in the opposite direction, the welding jaws 54, 55 are moved together by actuation of associated pressure cylinders for forming a separating weld seam. After completion of this seam the welding device 49 and the support plate 42 together with the filled plastics bag lying thereon travel back. The bag portion severed by the separating weld seam drops away downwardly. The welding jaws 54, 55 and the holding-down members 52, 53 are pushed apart again. During the return of the support plate 42 the ejector 47 enters between the abutments 45, 46 and pushes the filled and welded plastics bag off the plate, so that the now finished package leaves the wrapping zone downwardly. As soon as this has occurred and the welding device 49 has attained its inoperative position again (FIG. 1), the folding table 1 together with its magazine of plastics bags is swung upwards again by the cylinder 4. Thereafter the sequence of operations is repeated.

When, in accordance with a preferred embodiment of the invention, the slots 39, 41 illustrated in FIG. 8*a* are not provided in the plunger 23, the folder members 33, 34, after their actuation as shown in FIG. 9, lie initially against the side walls of the plunger 23. The folder members 33, 34 do not penetrate through the slots 31 in the flaps 27, 28 and form the fold until the plunger 23 has returned to its starting position shown in FIG. 10. and the flaps 27, 28 lie again against the inclined sides of the tongue 26 under the action of the spring 29. The folding of the folds is also supported in each case by the holding-down members 52, 53 moved together; the members 52, 53 hold back the balls of yarn inserted in the plastics bag until the fold has been completed and the welding jaws have moved together. In FIG. 11 the hatching indicates the folds 61, 62 formed in the plastics bag 14.

Figures 14, 15, 16, 17, 18, 19, 20, 21, 22:
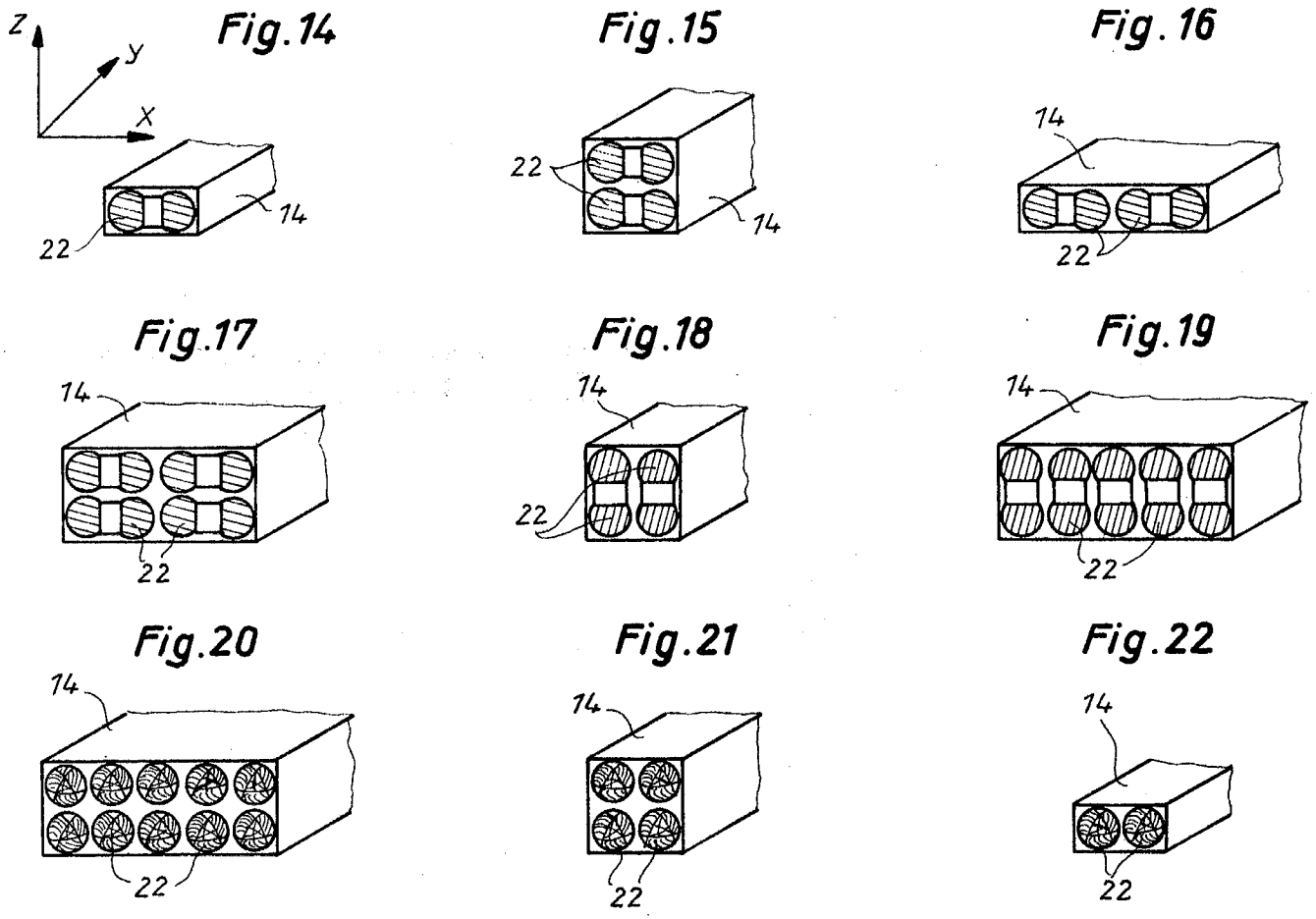

FIGS. 14 to 22 illustrate various kinds of wrappings which may be produced by means of the apparatus described above. The system of right-angled coordinates X, Y, Z also drawn in FIG. 14 serves to explain the spatial relations. The positions indicated in FIGS. 14 to 22 of the balls of yarn 22 in a plastics bag 14 of appropriate size naturally follows from the preceding arrangement of these balls in the collecting duct 16. Let it be assumed that in FIGS. 14 to 22 the bag opening always faces the viewer and accordingly the longitudinal axis of the bag extends in the Y-direction. FIG. 14 illustrates a single-layer arrangement of balls 22 in the plastics bag 14, the ball axis extending parallel to the X-direction. In FIG. 15 the plastics bag contains two superimposed layers of balls of yarn 22 corresponding to FIG. 14. The wrapping according to FIG. 16 contains in one layer two balls of yarn 22 the axes of which again extend parallel to the X-direction. The arrangement according to FIG. 17 is obtained from that according to FIG. 16 by doubling the layers of balls. The arrangement according to FIG. 18 differs from that corresponding to FIG. 15 in that one layer of balls 22 having ball axes extending parallel to the Z-direction is accommodated in the bag 14. In FIG. 19, five rows of balls having the same arrangement of the ball axes are disposed in one layer side by side in the bag 14. Finally, FIGS. 20, 21 and 22 illustrate wrappings in which balls 22 with their ball axes aligned in the Y-direction are inserted in one and more layers in a plastics bag 14.

I claim:

1. Apparatus for producing a wrapper closed by a weld seam from a plastics bag open at one side, for balls of yarn, comprising a collecting duct for holding balls of yarn, means for inserting the balls from the collecting duct into the uppermost bag of a stack of bags arranged in a magazine, two folder members for forming lateral folds in the bag, a welding device for closing the bag opening after the formation of the lateral folds by means of the two folder members, means for moving the collecting duct at least partly into the stationarily held bag, means for reciprocatingly moving the welding device between an operative position and an inoperative position, and means for tilting the magazine which is located in the displacement path of the welding device together with the remainder of the stack located thereon out of said path in the operative position of the welding device.

2. Apparatus according to claim 1, wherein the collecting duct and the welding device are guidable to the bag from opposite sides.

3. Apparatus according to claim 1, wherein the collecting duct is provided with recesses for entry of the folder members.

4. Apparatus according to claim 3, wherein the folder members are displaceably mounted on the collecting duct.

5. Apparatus according to claim 1, further comprising two flaps subjected to spring loading and pivotally arranged at the outlet end of the collecting duct facing the bag opening.

6. Apparatus according to claim 5, wherein the flaps have recesses therein for the passage therethrough of the folder members.

7. Apparatus according to claim 1, wherein the inserting means for the balls comprises a plunger arranged in the collecting duct.

8. Apparatus according to claim 7, wherein the plunger has lateral recesses for the entry of the folder members.

9. Apparatus according to claim 1, wherein the bag magazine is constructed as a folding table which is tiltable downwardly about an axis located in the vicinity of the bag opening.

10. Apparatus according to claim 1, further comprising an air nozzle directed into the opening of the uppermost bag and arranged at the bag magazine.

11. Apparatus according to claim 1, wherein the welding device comprises respective pairs of mutually associated holding-down members, welding jaws and draft rollers movable towards each other.

12. Apparatus according to claim 1, further comprising a displaceable support plate which supports the bag to be filled when the bag magazine is tilted out of the way.

13. Apparatus according to claim 12, wherein the support plate carries at least one abutment for the rear end of the bag to be filled.

14. Apparatus according to claim 12, further comprising an ejector associated with the support plate, which ejector ejects the welded bag filled with balls from the support plate.

15. Apparatus according to claim 1, wherein the means for operating the collecting duct, the welding device and the tiltable bag magazine comprise pressure cylinders.

* * * * *